US008528300B2

(12) United States Patent
Minor, Sr. et al.

(10) Patent No.: US 8,528,300 B2
(45) Date of Patent: Sep. 10, 2013

(54) APPARATUS FOR FACILITATING THE INSTALLATION OF A GUTTER AND METHOD OF INSTALLING A GUTTER USING THE APPARATUS

(76) Inventors: Kenneth W. Minor, Sr., Channahon, IL (US); Keith W. Minor, Sr., Channahon, IL (US)

( * ) Notice: Subject to any disclaimer, the term of this patent is extended or adjusted under 35 U.S.C. 154(b) by 294 days.

(21) Appl. No.: 12/846,498

(22) Filed: Jul. 29, 2010

(65) Prior Publication Data

US 2012/0023834 A1 Feb. 2, 2012

(51) Int. Cl.
*E04D 3/00* (2006.01)

(52) U.S. Cl.
USPC ..... 52/746.1; 52/11; 52/12; 52/13; 52/14; 52/15; 52/16

(58) Field of Classification Search
USPC ..... 52/746.1, 11–16
See application file for complete search history.

(56) References Cited

U.S. PATENT DOCUMENTS 3,592,721 A 7/1971 Formanek et al.
3,925,871 A 12/1975 Beaumont
5,617,678 A * 4/1997 Morandin et al. ..... 52/11
5,695,171 A 12/1997 Shine
5,953,861 A 9/1999 Podgwaite
D464,860 S 10/2002 Mrsny
D532,273 S 11/2006 Yoson
7,614,185 B2 * 11/2009 Brochu ..... 52/11
2007/0051210 A1 3/2007 Harpell
2008/0010906 A1 * 1/2008 Brochu ..... 52/12

* cited by examiner

*Primary Examiner* — Mark Wendell

(74) *Attorney, Agent, or Firm* — Wood, Phillips, Katz, Clark & Mortimer

(57) ABSTRACT

The combination of a building roof section and a flashing repositioning apparatus. The roof section has an upwardly facing surface, with an edge at which there is a fascia, and a depending flashing portion. The flashing repositioning apparatus has a flashing engaging assembly and a manipulating assembly. The flashing engaging assembly has a body defining a wedging surface and a guide surface. The guide surface is configured to be consistently located in a predetermined operative position against the fascia surface wherein the wedging surface is at a predetermined angle relative to the fascia surface. The wedging surface resides between the fascia surface and the flashing portion to define a gap into which a wall of a gutter can be directed.

20 Claims, 7 Drawing Sheets

Fig. 12
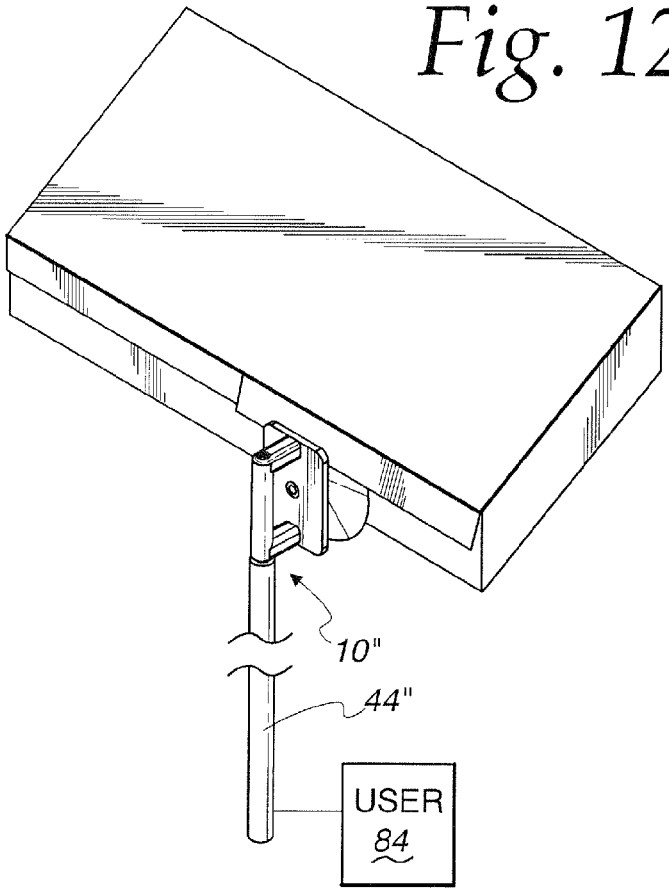
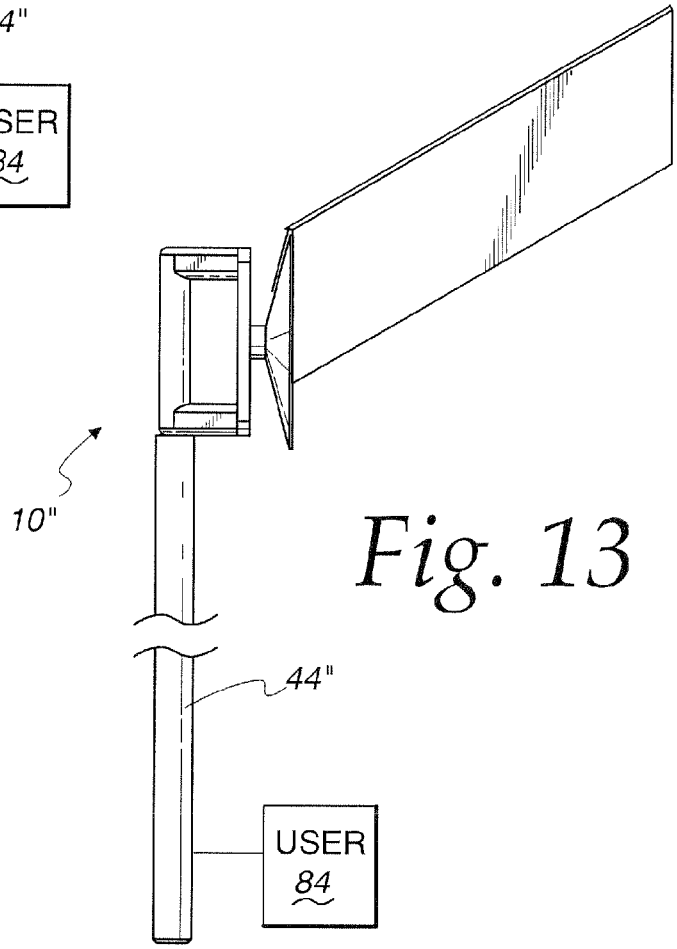
Fig. 13

APPARATUS FOR FACILITATING THE INSTALLATION OF A GUTTER AND METHOD OF INSTALLING A GUTTER USING THE APPARATUS

BACKGROUND OF THE INVENTION

1. Field of the Invention

This invention relates to gutters and, more particularly, to an apparatus that can be used to reposition flashing during gutter installation. The invention is also directed to a method of installing a gutter using the apparatus.

2. Background Art

In a typical roof construction, a width of flashing wraps around the bottom roof edge and over a fascia. A depending portion of the flashing overlies the vertical fascia surface and terminates at an edge that resides above the bottom of the fascia surface.

To install a gutter, a back wall on the gutter is directed between the depending flashing portion and the fascia surface whereby the flashing guides water into the gutter trough in a manner that it is not prone to encountering the fascia surface. The flashing is normally fixed in place before the gutter installation is carried out. The depending flashing portion is ideally formed to reside directly against the fascia surface over its vertical extent.

To effect the gutter installation, the installer is required to pry the bottom edge of the depending flashing portion away from the fascia to allow direction of the upper edge of the back wall of the gutter to between the flashing and fascia.

Prying of the flashing edge away from the fascia may be accomplished in a number of different manners. In the absence of any appropriate tools, the installer may use his/her fingers to draw the flashing edge outwardly at a starting location and progressively maintain the lower edge in spaced relationship to the fascia as lengths of gutter are progressively shifted upwardly into place.

Repositioning of the flashing by hand has a number of drawbacks. First of all, the installer is required to be in close proximity to the location at which the flashing is moved out from the fascia. If this action is carried out with the installer situated on the roof, he/she must lean precariously over the roof edge to engage the flashing. Further, since flashing is typically made from thin gauge metal, the bottom edge is inherently sharp, whereby the installer faces the risk of cutting him-/herself. This problem is aggravated in the event that the edge is not smooth or cleanly cut. The use of gloves by an installer may reduce the likelihood of being cut, but makes it difficult for the installer to engage the flashing edge as required to reposition the same.

As an alternative to the direct hand manipulation of the flashing, conventional type tools have been used for this purpose. Screwdrivers, pry bars, hammer claws, etc. have been used to draw the flashing edge away from the fascia during gutter installation. While using these tools avoids the direct contact between the installer's hands and the flashing, other problems are introduced.

Use of these tools generally requires that the installer strategically place a wedging portion thereon precisely at the bottom edge of the flashing to allow the tool to be introduced, and wedged, between the flashing and fascia. This action is convenient generally only when the installer is standing on a scaffolding and is in front of, and at the height of, the flashing edge. Attempting to perform this task while standing on the roof is awkward and requires that the user reach around the roof edge, which again may cause him/her to be precariously situated. From this location, the installer may also be required to make several attempts to locate the prying portion of the tool beneath the flashing edge, which may lie closely against the fascia surface.

Further, by using a relatively sharp tool during this process, the flashing may be locally deformed as the flashing is drawn outwardly using the tool. Any residual deformation, such as a localized bulged area, may create a passageway between the back gutter wall and the flashing through which water delivered to the gutter may migrate undesirably to against the fascia.

Heretofore, the use of conventional tools has made it for the most part impractical to reposition flashing from a spaced location, such as with the installer situated on the ground. If multiple individuals are working together to coordinate flashing repositioning and gutter placement, they are generally competing for space either on a scaffold or on the roof during this process. This may slow down the installation process and in a worst case may increase the likelihood of injury occurring during installations.

The industry continues to seek out gutter installation methods and apparatus to assist installation and that promote efficient installation in the safest possible manner.

SUMMARY OF THE INVENTION

In one form, the invention is directed to a method of installing a gutter, having a wall assembly with an upwardly projecting rear wall, against a surface of a fascia at which a depending flashing portion with a bottom edge is located. The method includes the steps of: obtaining a flashing repositioning apparatus having: a) a flashing engaging assembly with a body defining a wedging surface and a guide surface; and b) a manipulating assembly through which a user can controllably reposition the flashing engaging assembly. The user grasps a part of the manipulating assembly. Through the grasped manipulating assembly, the guide surface is placed in an operative position against the fascia surface wherein the wedging surface has a predetermined angular relationship with the fascia surface. The fascia surface and guide surface cooperate to maintain the predetermined angular relationship between the wedging surface and the fascia surface as the flashing repositioning apparatus is translated relative to the fascia surface. Through the grasped manipulating assembly, the guide surface is slid against the fascia surface while substantially maintaining the angular relationship between the wedging surface and the fascia surface to direct a part of the wedging surface between the depending flashing portion and the fascia surface to thereby progressively shift the bottom edge of the flashing portion away from the fascia surface. With the bottom edge of the flashing portion wedged away from the fascia surface, the rear wall of the gutter is directed upwardly between the flashing portion and the fascia surface. The gutter is suitably secured at the fascia.

In one form, the step of obtaining a flashing repositioning apparatus involves obtaining a flashing repositioning apparatus wherein the flashing engaging assembly has a body with a conical shape.

In one form, the step of obtaining a flashing repositioning apparatus involves obtaining a flashing repositioning apparatus having a body with a curved perimeter edge at which the wedging and guide surfaces meet.

In one form, the step of obtaining a flashing repositioning apparatus involves obtaining a flashing repositioning apparatus having a first handle assembly with a first graspable handle on the manipulating assembly and a shielding wall between the first graspable handle and wedging surface.

In one form, the step of obtaining a flashing repositioning assembly involves obtaining a flashing repositioning assembly in which the manipulating assembly has an elongate member with a second graspable handle that is spaced from the first graspable handle.

In one form, the step of obtaining a flashing repositioning assembly involves obtaining a flashing repositioning assembly in which the first graspable handle has an elongate graspable member with a length that extends in a first line and the elongate member has a length that extends in a second line that is substantially parallel to the first line.

In one form, the step of obtaining a flashing repositioning assembly involves obtaining a flashing repositioning assembly in which there are cooperating connecting parts on the first handle assembly and the elongate member that allow the elongate member to be selectively attached to and separated from the first handle assembly without requiring the use of separate fasteners.

In one form, the step of obtaining a flashing repositioning apparatus involves obtaining a flashing repositioning apparatus in which the guide surface has a curved shape corresponding to the curved edge and the fascia surface bridges portions of the guide surface with the guide surface against the fascia surface.

In one form, the step of obtaining a flashing repositioning apparatus involves obtaining a flashing repositioning apparatus in which the guide surface is substantially planar.

In one form, the step of obtaining a flashing repositioning apparatus involves obtaining a flashing positioning apparatus in which the conical body has a central axis and the manipulating assembly has a first handle assembly with a first graspable handle. The first graspable handle is an elongate graspable member with a length that extends in a line that makes an angle of from 70-90° with the central axis of the body.

In one form, the invention is directed to the combination of a building roof section and a flashing repositioning apparatus. The roof section has an upwardly facing surface, with an edge at which there is a fascia, and a depending flashing portion. The flashing repositioning apparatus has a flashing engaging assembly and a manipulating assembly. The flashing engaging assembly has a body defining a wedging surface and a guide surface. The guide surface is configured to be consistently located in a predetermined operative position against the fascia surface wherein the wedging surface is at a predetermined angle relative to the fascia surface. The wedging surface resides between the fascia surface and the flashing portion to define a gap into which a wall of a gutter can be directed.

In one form, the flashing engaging assembly has a body with a conical shape.

In one form, the flashing engaging assembly has a body with a curved perimeter edge at which the wedging and guide surfaces meet.

In one form, the manipulating assembly has a first handle assembly, with a first graspable handle, and a shielding wall between the first graspable handle and wedging surface.

In one form, the manipulating assembly has an elongate member with a second graspable handle that is spaced from the first graspable handle.

In one form, the first graspable handle has an elongate member with a length that extends in a first line and the elongate member has a length that extends in a second line that is parallel to the first line.

In one form, there are cooperating connecting parts on the first handle assembly and the elongate member that allow the elongate member to be selectively attached to and separated from the first handle assembly without requiring the use of separate fasteners.

In one form, the guide surface has a curved shape corresponding to the curved edge with portions that are bridged by the fascia surface with the guide surface in the operative position.

In one form, the guide surface is substantially planar.

In one form, the conical body has a central axis and the manipulating assembly has a first handle assembly with a first graspable handle. The first graspable handle is an elongate graspable member with a length that extends in a line that makes an angle of from 70-90° with the central axis of the body.

BRIEF DESCRIPTION OF THE DRAWINGS

FIG. 9 is a schematic, side elevation view of the roof section in

FIGS. 7 and 8 with the gutter installed;

FIG. 12 is a view as in FIG. 10 with the apparatus having an elongate member with a greater length to allow manipulation of the apparatus by a user on the ground;

FIG. 13 is a side elevation view of the components in FIG. 12;

DETAILED DESCRIPTION OF THE PREFERRED EMBODIMENT

Figure 1:
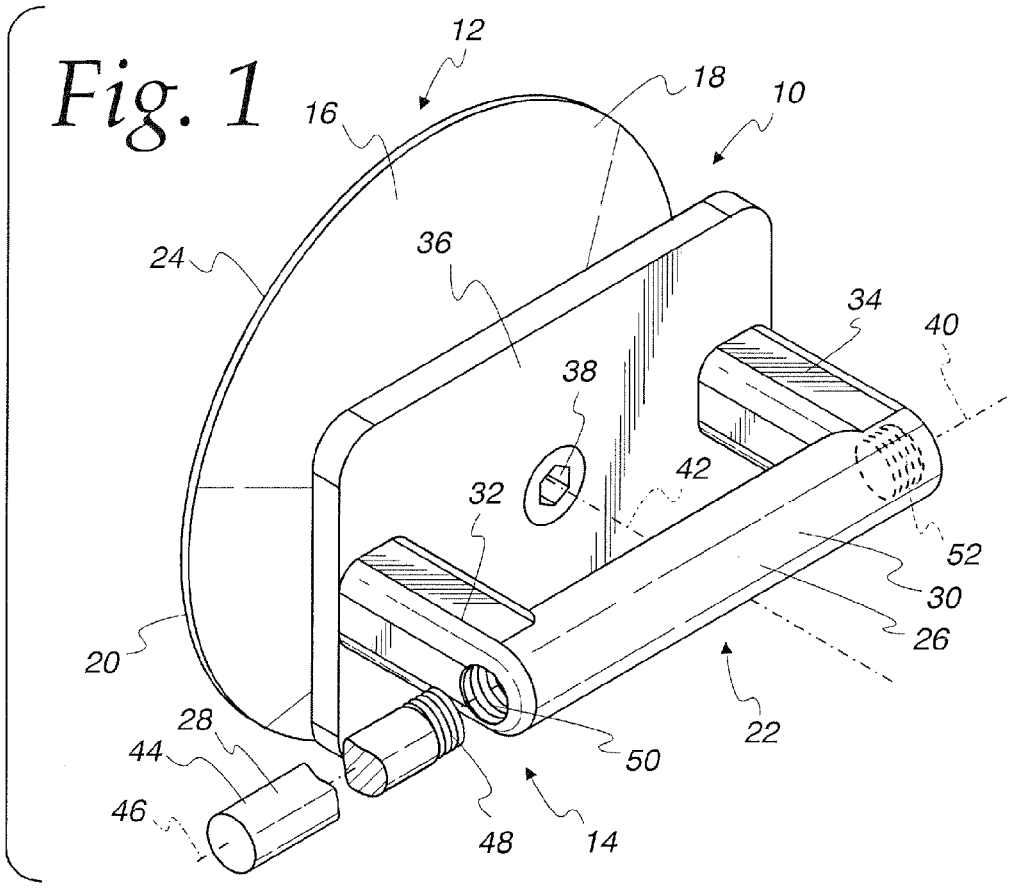
FIG. 1 is a partially exploded, perspective view of one form of flashing repositioning apparatus, according to the present invention, and including one form of elongate member that defines a graspable handle, shown separated from the remainder of the apparatus.
Figure 2:
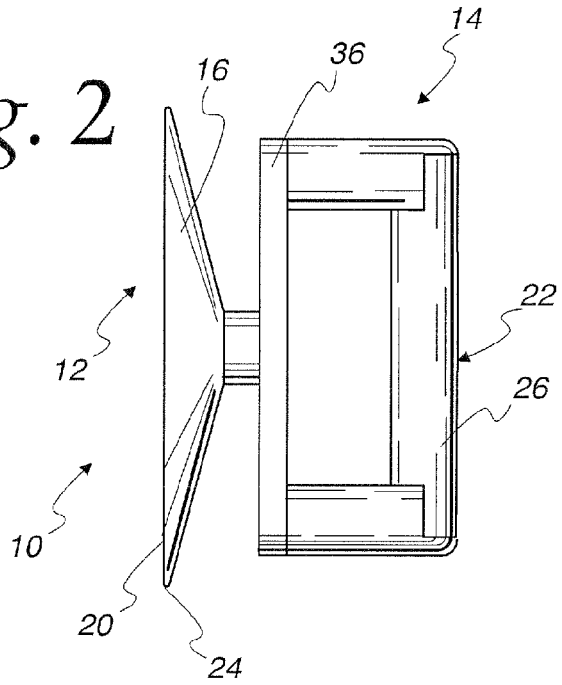
FIG. 2 is a reduced, plan view of the apparatus in FIG. 1 without the elongate member.

Referring initially to FIGS. 1-5, one exemplary and preferred form of a flashing repositioning apparatus, according to the present invention, is shown at 10. The flashing repositioning apparatus 10 consists of a flashing engaging assembly 12 and a manipulating assembly at 14.

The flashing engaging assembly 12 has a body 16 defining a wedging surface 18 and a guide surface 20.

In this embodiment, the body 16 has a conical shape that is truncated to facilitate connection to a first handle assembly 22 that is part of the manipulating assembly 14.

Figure 3:
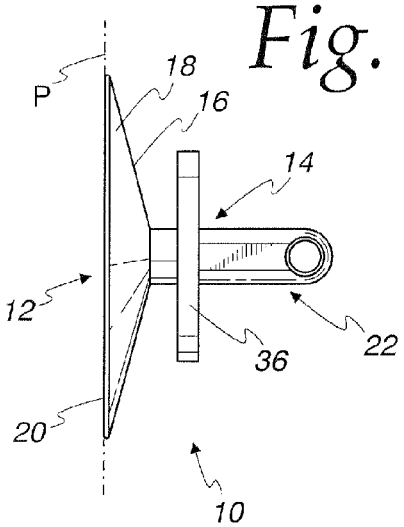
FIG. 3 is a reduced, side elevation view of the apparatus in FIGS. 1 and 2 without the elongate member.
Figure 4:
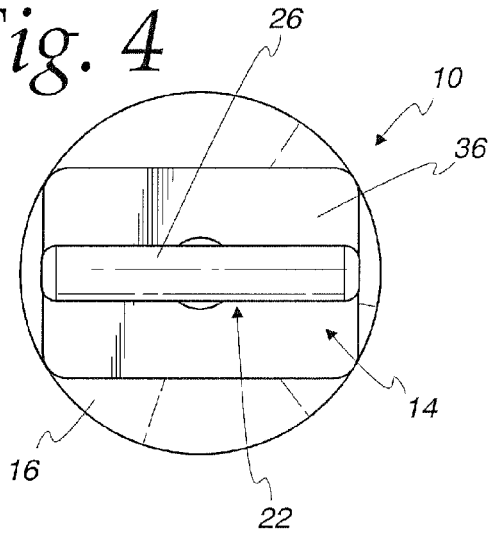
FIG. 4 is a reduced, front elevation view of the apparatus in FIGS. 1-3 without the elongate member.
Figure 5:
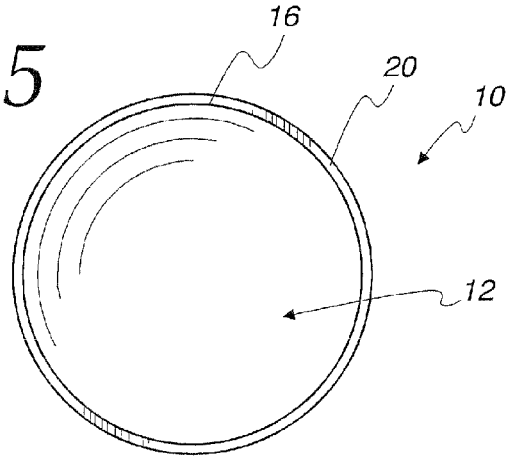
FIG. 5 is a reduced, rear elevation view of the apparatus in FIGS. 1-4 without the elongate member.

The conical body shape has a curved perimeter edge 24 at which the wedging and guide surfaces 18, 20 meet. With this construction, the guide surface 20 has the form of an annular edge/surface that resides within a plane P (FIG. 3).

Figure 14:
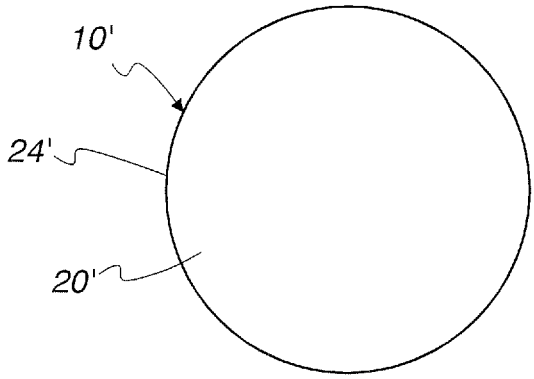
FIG. 14 is a view as in FIG. 5 of a modified form of apparatus, according to the invention.

Alternatively, as shown in FIG. 14 for a modified form of flashing repositioning apparatus 10', the corresponding guide surface 20' may be in the form of a planar surface that extends over the entire, or a portion of the, areal extent within the perimeter edge 24'.

The manipulating assembly 14, on the apparatus in FIGS. 1-5, consists of the aforementioned first handle assembly 22, that has a first graspable handle 26, and a second graspable handle 28. The separate graspable handles 26, 28 permit use of the flashing repositioning apparatus 10 in different manners as described hereinbelow. It should be understood that the apparatus 10 might also be made with either of the graspable handles 26, 28 without the other.

The first graspable handle 26 consists of an elongate graspable member 30, having a generally cylindrical shape around which a user's fingers can be wrapped. The elongate member 30 has at its opposite ends mounting legs 32, 34 that are fixedly joined to the elongate member 30 to define therewith a "U" shape. The mounting legs 32, 34 are fixed to a mounting/shielding wall 36 that is fixed to the body 16 through a threaded fastener 38.

The elongate member 30 has a length extending along a central axis 40 that is substantially orthogonal to the central axis 42 of the body 16. This orthogonal relationship, however, is not required and may be deviated from, as in the event the apparatus is intended to be consistently used in only one angular orientation.

The second graspable handle 28 consists of an elongate member 44 with a length extending along a central axis 46. The elongate member 44 is shown with a substantially cylindrical shape to define a handle that can be grasped selectively at any location along that length.

As noted above, the elongate member 44 is designed to be releasably attached to the body 16 through the first graspable handle 26, or a structure at that location in the event the first handle assembly 22 is absent. More particularly, there is a connecting part 48 on the elongate member 44 that separately cooperates selectively with connecting parts 50, 52 at the ends of the elongate member 30. In this embodiment, the cooperating connecting parts 48; 50, 52 are respectively male and female threaded parts that allow the elongate member 44 to be releasably attached at either end of the elongate member 30 without requiring any tools or separate fasteners.

With this arrangement, the central axes 40, 46 of the elongate members 30, 44 are coincident with the elongate member 44 attached to the first handle assembly 22 and projecting in either of opposite directions therefrom.

It is not necessary that there be connecting parts 48, 50 at both ends of the first handle assembly 22. Further, while the axis 40 of the elongate member 30 is shown orthogonal to the body axis 42, this angle may be varied, as in the range of 20°, for purposes that will be apparent from the description of the use of the apparatus, below.

While it is not necessary that the lengths of the elongate members 30, 44 be parallel to each other, this is a preferred orientation to allow the apparatus to function the same, regardless of its angular orientation with respect to the body axis 42. The length of the elongate member 44, extending along the axis 46, may be at an angle to the length of the elongate member 30 along its respective axis 40.

One manner of using the flashing repositioning apparatus 10 is shown in FIGS. 6-9. In those Figures, the apparatus 10 is used to reposition flashing 54 as shown on a roof section 56. The roof section 56 has an upwardly facing surface 58 with an appropriate waterproof covering, that may consist of one or multiple layers 59, and extends to a perimeter edge 60 at which there is a fascia 62 with an outwardly facing vertical surface 64.

The flashing 54 is applied against the surface 58 and bent to define a depending portion 66 that overlies the fascia surface 64 and terminates at a bottom edge 68.

Figure 9:
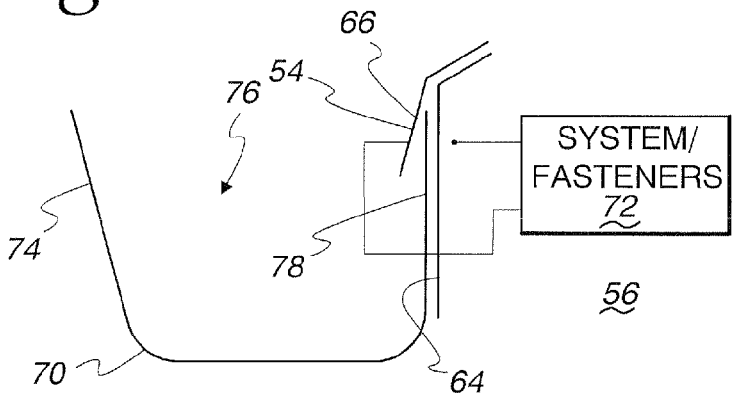

As shown in FIG. 9, a gutter 70 is attached at the fascia surface 64 using a suitable system/fasteners 72. The gutter 70 has a wall assembly 74 defining an internal trough 76 for funnelling of water to an appropriate downspout or the like (not shown). The wall assembly 74 includes a rear wall 78 that is directed upwardly during installation to between the depending flashing portion 66 and fascia surface 64 preparatory to securing the gutter 70 at the fascia 62.

Figure 6A:
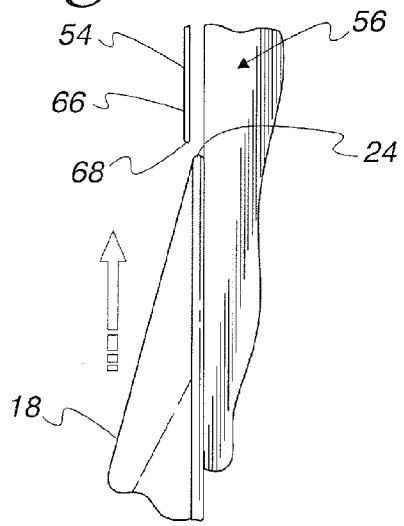
FIG. 6*a* is a fragmentary, side elevation view of a portion of the apparatus in FIGS. 1-5 situated beneath a depending flashing portion at a fascia.
Figure 6B:
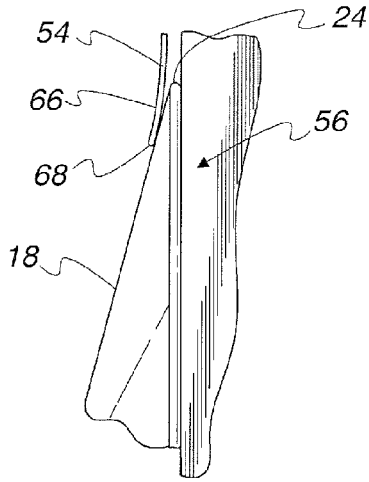
FIG. 6*b* is a view as in 6*a* with the apparatus shifted upwardly to move the bottom edge of the flashing portion away from the fascia.
Figure 7:
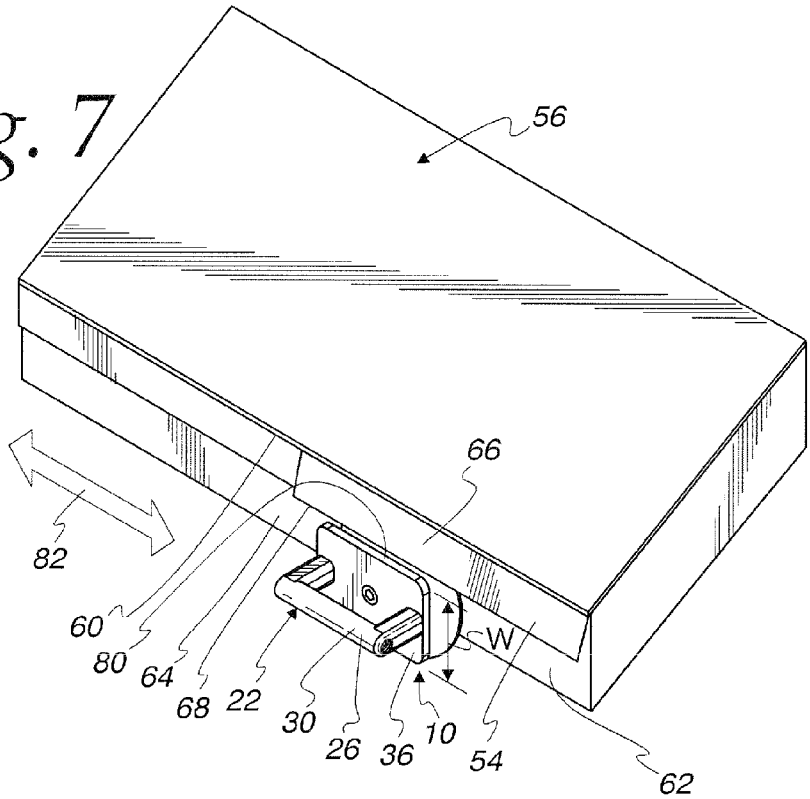
FIG. 7 is a fragmentary perspective view of a roof section and with the apparatus in FIGS. 1-5 in the position shown in FIG. 6*b;*
Figure 8:
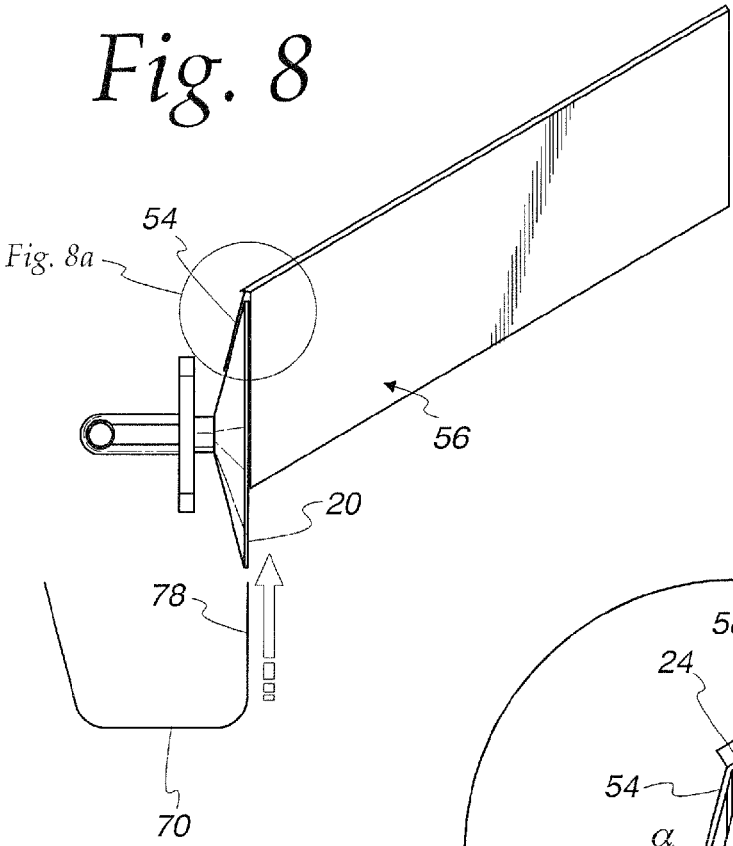
FIG. 8 is a side elevation view of the components in FIG. 7 and with a gutter therebeneath preparatory to installation.
Figure 8A:
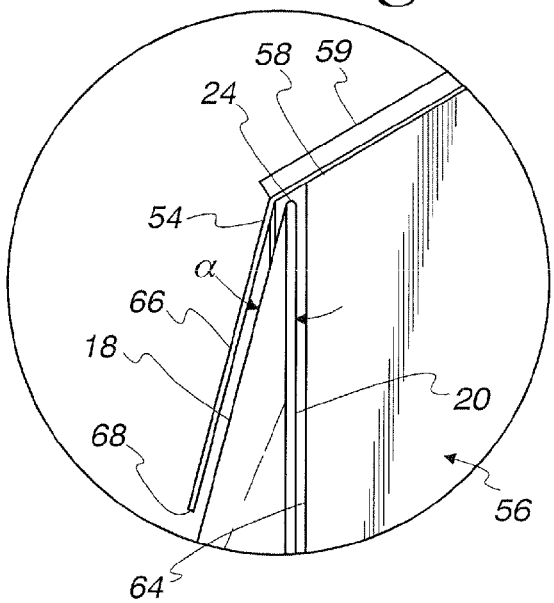
FIG. 8*a* is an enlarged view of the portion within the circle in FIG. 8.

The apparatus 10 is shown in FIGS. 6-10 without the elongate member 44 connected. With this configuration, the user holds and repositions the apparatus 10 by grasping the elongate member 30 on the first handle assembly 22. The user controllably repositions the apparatus 10 to thereby wedge the depending flashing portion 66 away from the fascia surface 64, as seen in FIGS. 8 and 8*a*, whereupon the rear gutter wall 78 can be conveniently directed upwardly to between the depending flashing portion 66 and the fascia surface 64.

More particularly, the guide surface 20 is configured to be consistently located in a predetermined operative position against the fascia surface 64 wherein the wedging surface 18 is at a predetermined angle $\alpha$ (FIG. 8*a*) relative to the fascia surface 64. The fascia surface 64 bridges portions of the annular surface 20. In this embodiment, the angle $\alpha$ in FIG. 8*a* is on the order of 20° but could be considerably more or less as appropriate. The normal anticipated angular range is from 10° to 40°. With this arrangement the guide surface 20 can be placed in its operative position flushly against the fascia surface 64, whereupon the body 16 can be translated guidingly along the fascia surface 64.

Typically, the guide surface 20 is placed in the operative position with the perimeter edge 24 beneath the bottom flashing edge 68 as shown in FIG. 6*a*. While maintaining this operative position for the guide surface 20, the apparatus 10 can be shifted upwardly, as shown in FIG. 6*b*, by applying a force through the first handle assembly 22 to cause the wedging surface 18 to progressively shift the bottom edge 68 of the flashing portion 66 away from the fascia surface 64, thereby to allow the rear wall 78 of the gutter 70 to be directed upwardly, as shown in FIG. 8, to between the flashing portion 66 and the fascia surface 64.

With the apparatus 10 configured as in FIGS. 6-9, the user can conveniently manipulate the apparatus 10 from either upon the roof surface or upon a scaffold adjacent to the fascia 62.

As seen in FIG. 7, the mounting/shielding wall 36, which has a rectangular shape, has a narrower width W arranged so that with the user grasping the handle 26, and the length thereof aligned generally horizontally, the upper portion of the body 16 remains visible above the edge 80 to facilitate initial location of the apparatus 10 at the flashing edge 68.

Once the wedging surface 18 has shifted the bottom flashing edge 68 outwardly from the fascia surface 64, the user can slide the apparatus 10 horizontally, as indicated by the double-headed arrow 82 in FIG. 7, along the flashing portion 66 as desired to progressively seat the gutter rear wall 78.

As can be seen most clearly in FIG. 8*a*, the perimeter edge 24 of the body may be rounded to avoid hang-up as the apparatus 10 is translated guidingly against the fascia surface 64 with the guide surface 20 in the operative position. This rounded configuration for the edge 24 also reduces the likelihood that the body 16 will snag on the bottom flashing edge 68 as the body 16 is directed to between the depending flashing portion 66 and fascia surface 64.

Figure 10:
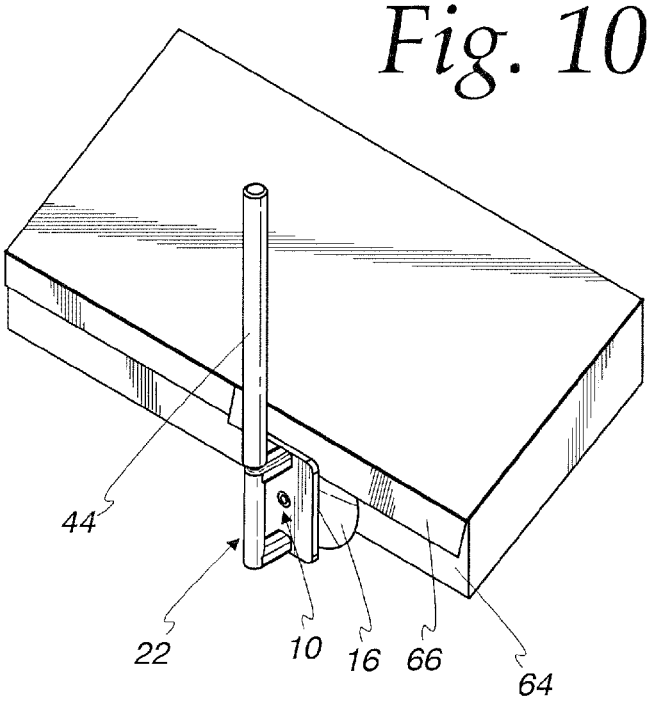
FIG. 10 is a view as in FIG. 7 with the apparatus having an elongate member attached thereto that facilitates manipulation from on top of the roof.
Figure 11:
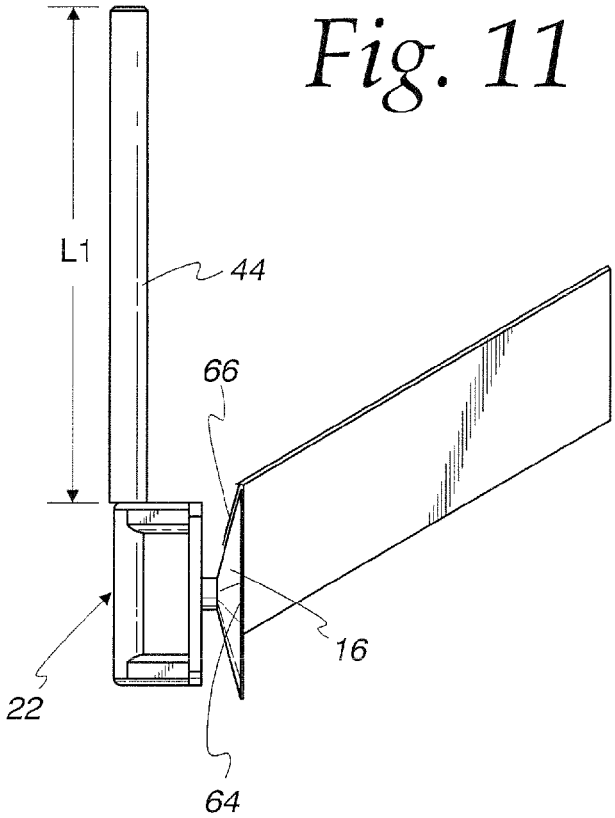
FIG. 11 is a side elevation view of the components in FIG. 10.

In FIGS. 10 and 11, the elongate member 44 having a first length L1 is operatively connected to the first handle assembly 22. The elongate member 44 may have a length L1 on the order of 1-3 feet, but may be longer or shorter to meet the particular application. With this configuration, the apparatus 10 can be turned 90° around the body axis 42 from the orientation shown in FIG. 7 so that the connected elongate member 44 projects upwardly above the roof surface 58 to be conveniently manipulated by a user standing on the roof. The operation of the apparatus 10 is otherwise the same as described with respect to FIGS. 6-9. That is, the elongate member 44 is grasped and drawn upwardly to the position shown in FIGS. 10 and 11 to cause the body 16 to deflect the depending flashing portion 66 away from the fascia surface 64 to facilitate placement of the gutter 70.

In FIGS. 12 and 13 a modified form of the apparatus is shown at 10", with the only difference being that the elongate member 44 in FIGS. 10 and 11 is replaced with an elongate member 44" having a greater length, dictated by a particular application/site. With this configuration, a user 84 can be situated on the ground and grasp the elongate member 44" to reposition the apparatus 10" in the same manner the apparatus 10 is repositioned as previously described.

It is also possible that the apparatus may be configured with both elongate members 44, 44" operatively connected whereby the apparatus can be engaged and repositioned simultaneously by individuals/users at two different locations.

The above description relates to preferred embodiments of the invention but should not be viewed as limiting. Many variations from the basic structure described are contemplated.

For example, the body 16 does not have to be made with the continuous conical shape. A continuous conical shape allows the apparatus to operate substantially identically with the apparatus turned to any angular position around the axis 42. However, a segment of a cone, or other like shape, strategically located relative to the handle assembly 22, might be employed that would operate in the same manner without the same flexibility in terms of orientation.

Figure 15:
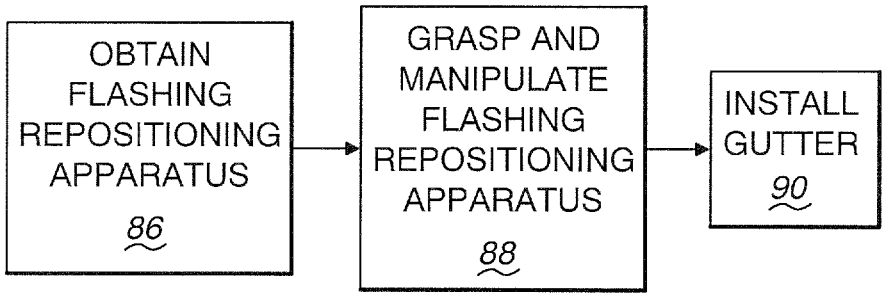
FIG. 15 is a block diagram representation of a method for installing a gutter utilizing the inventive apparatus.

With the structure as described above, a gutter can be installed as shown schematically in FIG. 15. As shown at block 86, a flashing repositioning apparatus is obtained. As shown at block 88, the flashing repositioning apparatus is grasped and manipulated to thereby reposition a depending flashing portion. After this occurs, as shown at block 90, a gutter is put in place and secured to complete the assembly.

The foregoing disclosure of specific embodiments is intended to be illustrative of the broad concepts comprehended by the invention.

The invention claimed is:

1. In combination:

a) a building roof section having an upwardly facing surface with an edge at which there is a fascia with a surface, the roof section further having a depending flashing portion at the fascia surface with a bottom edge; and b) a flashing repositioning apparatus comprising:

i) a flashing engaging assembly; and ii) a manipulating assembly, the flashing engaging assembly comprising a body defining a wedging surface and a guide surface, the guide surface configured to be consistently located in a predetermined operative position against the fascia surface wherein the wedging surface is at a predetermined angle relative to the fascia surface, the wedging surface residing between the fascia surface and the flashing portion to define a gap into which a wall of a gutter can be directed to be secured to the fascia, the flashing repositioning apparatus remaining separable from the fascia and a gutter with the gutter secured to the fascia.

2. The combination according to claim 1 wherein the flashing engaging assembly comprises a body with a conical shape.

3. The combination according to claim 2 wherein the conical body has a central axis and the manipulating assembly comprises a first handle assembly with a first graspable handle and the first graspable handle comprises an elongate graspable member with a length that extends in a line that makes an angle of from 70-90° with the central axis of the body.

4. The combination according to claim 1 wherein the flashing engaging assembly comprises a body with a curved perimeter edge at which the wedging and guide surfaces meet.

5. The combination according to claim 4 wherein the manipulating assembly comprises a first handle assembly with a first graspable handle and a shielding wall between the first graspable handle and wedging surface.

6. The combination according to claim 4 wherein the guide surface is substantially planar.

7. In combination:

a) a building roof section having an upwardly facing surface with an edge at which there is a fascia with a surface, the roof section further having a depending flashing portion at the fascia surface with a bottom edge; and b) a flashing repositioning apparatus comprising:

i) a flashing engaging assembly; and ii) a manipulating assembly, the flashing engaging assembly comprising a body defining a wedging surface and a guide surface, the guide surface configured to be consistently located in a predetermined operative position against the fascia surface wherein the wedging surface is at a predetermined angle relative to the fascia surface, the wedging surface residing between the fascia surface and the flashing portion to define a gap into which a wall of a gutter can be directed, wherein the flashing engaging assembly comprises a body with a curved perimeter edge at which the wedging and guide surfaces meet, wherein the manipulating assembly comprises a first handle assembly with a first graspable handle and a shielding wall between the first graspable handle and wedging surface, wherein the manipulating assembly comprises an elongate member with a second graspable handle that is spaced from the first graspable handle.

8. The combination according to claim 7 wherein the first graspable handle comprises an elongate member with a length that extends in a first line and the elongate member has a length that extends in a second line that is parallel to the first line.

9. The combination according to claim 7 wherein there are cooperating connecting parts on the first handle assembly and the elongate member that allow the elongate member to be selectively attached to and separated from the first handle assembly without requiring the use of separate fasteners.

10. In combination:

a) a building roof section having an upwardly facing surface with an edge at which there is a fascia with a surface, the roof section further having a depending flashing portion at the fascia surface with a bottom edge; and b) a flashing repositioning apparatus comprising:

i) a flashing engaging assembly; and ii) a manipulating assembly, the flashing engaging assembly comprising a body defining a wedging surface and a guide surface, the guide surface configured to be consistently located in a predetermined operative position against the fascia surface wherein the wedging surface is at a predetermined angle relative to the fascia surface, the wedging surface residing between the fascia surface and the flashing portion to define a gap into which a wall of a gutter can be directed, wherein the flashing engaging assembly comprises a body with a curved perimeter edge at which the wedging and guide surfaces meet, wherein the guide surface has a curved shape corresponding to the curved edge with portions that are bridged by the fascia surface with the guide surface in the operative position.

11. A method of installing a gutter, the method comprising the steps of:

providing the combination of claim 1;

providing a gutter having a wall assembly with an upwardly projecting rear wall, the gutter to be installed against the surface of the fascia at which the depending flashing portion is located;

grasping a part of the manipulating assembly;

through the grasped manipulating assembly placing the guide surface in an operative position against the fascia surface wherein the wedging surface has a predetermined angular relationship with the fascia surface, the fascia surface and guide surface cooperating to maintain the predetermined angular relationship between the wedging surface and the fascia surface as the flashing repositioning apparatus is translated relative to the fascia surface;

through the grasped manipulating assembly, sliding the guide surface against the fascia surface while substantially maintaining the angular relationship between the wedging surface and the fascia surface to direct a part of the wedging surface between the depending flashing portion and the fascia surface to thereby progressively shift the bottom edge of the flashing portion away from the fascia surface;

with the bottom edge of the flashing portion wedged away from the fascia surface, directing the rear wall of the gutter upwardly between the flashing portion and the fascia surface;

separating the flashing positioning apparatus from the roof section and the gutter; and securing the gutter at the fascia while maintaining the manipulating assembly separable from the gutter and fascia.

12. The method of installing a gutter according to claim 11 wherein the flashing engaging assembly comprises a body with a conical shape.

13. The method of installing a gutter according to claim 11 wherein the flashing repositioning apparatus comprises a body with a curved perimeter edge at which the wedging and guide surfaces meet.

14. The method of installing a gutter according to claim 13 wherein the flashing repositioning apparatus comprises a first handle assembly with a first graspable handle on the manipulating assembly and a shielding wall between the first graspable handle and wedging surface.

15. A method of installing a gutter comprising the steps of:

providing the combination of claim 1;

providing a gutter having a wall assembly with an upwardly projecting rear wall, the gutter installed against the surface of the fascia at which the depending flashing portion is located;

grasping a part of the manipulating assembly;

through the grasped manipulating assembly placing the guide surface in an operative position against the fascia surface wherein the wedging surface has a predetermined angular relationship with the fascia surface, the fascia surface and guide surface cooperating to maintain the predetermined angular relationship between the wedging surface and the fascia surface as the flashing repositioning apparatus is translated relative to the fascia surface;

through the grasped manipulating assembly, sliding the guide surface against the fascia surface while substantially maintaining the angular relationship between the wedging surface and the fascia surface to direct a part of the wedging surface between the depending flashing portion and the fascia surface to thereby progressively shift the bottom edge of the flashing portion away from the fascia surface;

with the bottom edge of the flashing portion wedged away from the fascia surface, directing the rear wall of the gutter upwardly between the flashing portion and the fascia surface;

separating the flashing positioning apparatus from the roof section and the gutter; and securing the gutter at the fascia, wherein the flashing repositioning apparatus comprises a body with a curved perimeter edge at which the wedging and guide surfaces meet, wherein the flashing repositioning apparatus comprises a first handle assembly with a first graspable handle on the manipulating assembly and a shielding wall between the first graspable handle and wedging surface, wherein the manipulating assembly comprises an elongate member with a second graspable handle that is spaced from the first graspable handle.

16. The method of installing a gutter according to claim 15 wherein the first graspable handle comprises an elongate graspable member with a length that extends in a first line and the elongate member has a length that extends in a second line that is substantially parallel to the first line.

17. The method of installing a gutter according to claim 15 wherein there are cooperating connecting parts on the first handle assembly and the elongate member that allow the elongate member to be selectively attached to and separated from the first handle assembly without requiring the use of separate fasteners.

18. A method of installing a gutter comprising the steps of:

providing the combination of claim 1;

providing a gutter having a wall assembly with an upwardly projecting rear wall, the gutter installed against the surface of the fascia at which the depending flashing portion is located;

grasping a part of the manipulating assembly;

through the grasped manipulating assembly placing the guide surface in an operative position against the fascia surface wherein the wedging surface has a predetermined angular relationship with the fascia surface, the fascia surface and guide surface cooperating to maintain the predetermined angular relationship between the wedging surface and the fascia surface as the flashing repositioning apparatus is translated relative to the fascia surface;

through the grasped manipulating assembly, sliding the guide surface against the fascia surface while substantially maintaining the angular relationship between the wedging surface and the fascia surface to direct a part of the wedging surface between the depending flashing portion and the fascia surface to thereby progressively shift the bottom edge of the flashing portion away from the fascia surface;

with the bottom edge of the flashing portion wedged away from the fascia surface, directing the rear wall of the gutter upwardly between the flashing portion and the fascia surface;

separating the flashing positioning apparatus from the roof section and the gutter; and securing the gutter at the fascia, wherein the flashing repositioning apparatus comprises a body with a curved perimeter edge at which the wedging and guide surfaces meet, wherein the guide surface has a curved shape corresponding to the curved edge and the fascia surface bridges portions of the guide surface with the guide surface against the fascia surface.

19. The method of installing a gutter according to claim 13 wherein the guide surface is substantially planar.

20. The method of installing a gutter according to claim 12 wherein the conical body has a central axis and the manipulating assembly comprises a first handle assembly with a first graspable handle and the first graspable handle comprises an elongate graspable member with a length that extends in a line that makes an angle of from 70-90° with the central axis of the body.

* * * * *